US010478712B2

(12) United States Patent
Lin et al.

(10) Patent No.: US 10,478,712 B2
(45) Date of Patent: Nov. 19, 2019

(54) DISPOSABLE SEALING PIECE HAVING GAME UNIT

(71) Applicant: John Lin, Hsinchu County (TW)

(72) Inventors: John Lin, Hsinchu County (TW); Ru-Ling Cheng, Hsinchu County (TW)

(73) Assignee: John Lin, Hsinchu County (TW)

( * ) Notice: Subject to any disclaimer, the term of this patent is extended or adjusted under 35 U.S.C. 154(b) by 0 days.

(21) Appl. No.: 16/031,571

(22) Filed: Jul. 10, 2018

(65) Prior Publication Data

US 2019/0015735 A1 Jan. 17, 2019

(30) Foreign Application Priority Data

Jul. 11, 2017 (TW) ..... 106123145 A

(51) Int. Cl.
*A63F 5/04* (2006.01)
*A63F 9/00* (2006.01)

(52) U.S. Cl.
CPC ..... *A63F 5/04* (2013.01); *A63F 9/001* (2013.01); *A63F 2009/0012* (2013.01); *A63F 2009/0013* (2013.01); *A63F 2009/0015* (2013.01); *A63F 2009/0053* (2013.01); *A63F 2009/0058* (2013.01); *A63F 2250/024* (2013.01); *A63F 2250/04* (2013.01)

(58) Field of Classification Search
CPC ..... A63F 2009/0012; A63F 2009/0015; A63F 2009/0013; A63F 2009/0058; A63F 2009/0053; A63F 5/04; A63F 9/001; A63F 2250/024; A63F 2250/04
USPC ..... 273/139, 138.1, 141 R; 283/901, 903, 283/803
See application file for complete search history.

(56) References Cited

U.S. PATENT DOCUMENTS 2,224,996 A * 12/1940 Walsh ..... A63F 5/04 273/141 R
7,402,092 B1 * 7/2008 Randall ..... A47G 19/2227 220/705
2006/0124577 A1 * 6/2006 Ross ..... B32B 5/245 215/347

* cited by examiner

*Primary Examiner* — Benjamin Layno
(74) *Attorney, Agent, or Firm* — Chun-Ming Shih

(57) ABSTRACT

Disclosed is a disposable sealing piece having a game unit, the sealing piece is a sealing film or an upper cover, to cover and seal an opening of a disposable container. A print layer is disposed on surface of the disposable sealing piece, and on the print layer is disposed at least a game unit. When a cup, a bowl of disposable container, or a meal box is covered with the sealing film or the upper cover, it is capable of providing game functions of context interactions. The structure of the disposable sealing piece makes use of the conventional sealing piece, and through patterns of elaborate design, to integrate body gesture, mood, and game together, to provide and present a combined real scene for the entertainment of the user. The game thus obtained include various dances, sports, Kungfu, combined real scene, and parent-child interactions.

7 Claims, 10 Drawing Sheets

4

DISPOSABLE SEALING PIECE HAVING GAME UNIT

BACKGROUND OF THE INVENTION

Field of the Invention

The present invention relates to a sealing technology for a disposable container, and in particular to a disposable sealing piece having a game unit.

The Prior Arts

Presently, the conventional cup having game functions can be mainly classified into two categories. For the first category of the Prior Art, the game unit is disposed on the cup cover. Its overall structure is complicated, while its cost is high. Further, the disadvantages of this type are that, the sorts of games it can provide are quite few, and once the game is set and fixed, then it can not be changed. And in application, the user has to prepare his own cap and cover by himself, and the user is not allowed to play different kinds of games quite often, so he/she tends to lose interest and sense of novelty for the cup lid games. For the second category of the Prior Art, the design of its cup body is even more complicated, so that in manufacturing and game playing, it is relatively complex and rather difficult.

Paper Cup is invented by Luellen in Boston U.S. in 1907, thus it has existed for more than one hundred years. However, with regard to the game design of paper cup, it has not exceeded the scope of the first category of the Prior Art. In this respect, the beverage cup covers utilized by McDonald's, Kentucky Fired Chicken, and Starbuck Coffee world famous chain stores are all flat covers of pure white and pure black. The reason for this is that, the game designs of cup mentioned above are overly complicated, high cost, and lacking in variations. So, these kinds of game designs are scarcely put into use, and they have never come into vogue. Therefore, up to now, the mainstream of cup cover utilized is still of flat cover. On the cup cover, the design of characters, drawings, and games are lacking, and the game function is missing.

The handshake beverage cup sealer was invented by Mr. Ye-Yifang in 1981, and it has been forty years ever since. On the sealing glue film is mainly disposed art patterns or literature sentences, some jokes, and quick wits quizzes. Yet, this kind of design can hardly catch the attentions of the users. Therefore, presently, the sealing films or the cup covers for most of the beverage chain stores utilize company logos or patterns, without putting on any drawings or characters of no remarkable effects.

Therefore, presently, the design and performance of the disposable sealing piece is not quite satisfactory, and it leaves much room for improvement.

SUMMARY OF THE INVENTION

In view of the problems and drawbacks of the prior art, the present invention provides a disposable sealing piece having a game unit, used to cover and seal an opening of a disposable container. The disposable sealing piece is formed by a sealing film or an upper cover. The sealing film is made of one of the followings: a metal film, a paper film, and a plastic film. Around a perimeter of the upper cover is disposed a ring of fastening cover rim. A tangent insertion port may be provided in a center of the beverage cup cover. The upper cover is made of metal or plastic.

A print layer is disposed on a surface of the disposable sealing piece, and at least a game unit capable of context interactions is disposed on the print layer, to act in cooperation with a playing tool to perform selection of games.

Wherein, patterns of the game unit on the print layer can be formed by two modes respectively. In a first mode, a pattern of the game unit of the print layer is printed directly on the surface of the sealing film. While in the second mode, the pattern of the game unit of the print layer is first printed on a sticker, then the sticker is glued onto the surface of the sealing film.

In general, the game unit can be classified into at least eight sequences, that include but not limited to: a real life reality sequence, a regimen and health care sequence, a human interaction sequence, a yoga & dance sequence, a child cherish sequence, a Kungfu boxing sequence, a divination healing sequence, and a child wisdom enhancement sequence. In fact, the game contents can be much more than that mentioned above, but the present invention is not limited to the above.

The playing tool can be one of the following: a straw, chopsticks, a tooth pick, a fork, a spoon, a petite knife, petite knife and fork, a fruit fork used frequently in our daily life; or even a dart, an arrow, a sword, and a knife of specially made tools, to act in cooperation with the game unit.

Further, the present invention also provides a disposable sealing piece having a game unit, used to cover and seal an opening of a disposable container. The disposable sealing piece is formed by a plurality of continuous sealing films, and the sealing film is made of one of the followings: a metal film, a paper film, and a plastic film. On the respective sealing film a game of different context interactions can be played, that means that a print layer is disposed on the respective sealing film, and on the print layer is disposed a different game unit. The game unit can be classified into at least eight kinds of sequences, that include but not limited to: a real life reality sequence, a regimen and health care sequence, a human interaction sequence, a yoga & dance sequence, a child cherish sequence, a Kungfu boxing sequence, a divination healing sequence, and a child wisdom enhancement sequence. In fact, the game contents can be much more than that mentioned above, and the present invention is not limited to the above. When the game unit is used on the opening of the disposable container, different games may appear at random on the sealing films.

On the print layer is provided with a marking region, and in the marking region is printed the following: a text description unit, the text described corresponding to that of the game unit; a trade mark identification unit, and a transparent small window of a round shape.

The game unit includes one of the print patterns of one of the following sequences: the real life reality sequence, including a real scene game in a park, strolling along a street, car and drink, outdoor activities; the regimen and health care sequence, including light exercise, office micro exercise, dynamic warm-up, static warm-up, target exercise, health exercise; the human interaction sequence, including love-to-eat, eating game; the yoga & dance sequence, including yoga, ballet, break dance, street dance, pedal dance, folk dance; the child cherish sequence, including hand shadow game, string magic trick, one-foot push, grabbing sandbag; a Kungfu boxing sequence, including Tai-Chi boxing, and mantis boxing; a divination healing sequence, including do-you-love-me? can we make a couple? forecast of fortune, exorcist; and a child wisdom enhancement sequence, including strolling through a zoo, fast food, global land marks, poker, dice, and numeral games.

The playing tool can be designed into a rotation pointer for selecting specific games. The rotation pointer includes a base seat and a rotable needle. One end of the base seat is fixed in a center of the game unit on the disposable sealing piece, and the rotable needle is pivotably connected to the other end of the base seat, to be rotated to point to the pattern of the game unit.

The base seat is provided with a cavity, and the rotable needle is pivotably connected to a ball shape tenon.

The base seat is provided with a cavity, being pivotably connected to the ball shape tenon, one end of the ball shape tenon is protruded to have a clip, for clipping the detachable and rotable needle. The clip can be formed by one of a suction tube, a chop stick, a knife, and a fork.

On the base seat is disposed a protrusion pillar, and around the protrusion pillar is disposed a ring of groove. An end of the rotable needle is disposed a sleeve ring, to be pivotably sleeved into the groove of the protrusion pillar of the base seat.

In a bottom portion of the base seat is provided with an insertion and connection portion. At a front portion of the insertion and connection portion is disposed a cone shape puncture end, while a suction tube insertion hole is disposed between the protrusion pillar of the base seat and the puncture end.

Summing up the above, in the present invention, when the disposable container such as a cup, a bowl, or a meal box, is covered with a disposable sealing film or an upper cover, they could provide the games of context interactions. As such, while enjoying a meal, the user may pick up any playing tools nearby, such as a straw, chopsticks, a tooth pick, a fork, a spoon, a petite knife, a petite knife and fork, a fruit fork utilized in our daily life; or even a dart, an arrow, a sword, and a knife of specially made tools, or a rotation pointer, to act in cooperation with the game unit. As such, simple, interesting and playful games of context interactions can be performed on the game unit of the disposable sealing piece, to bring happiness and delight to a user while he is eating and dining.

Compared with the Prior Art, the present invention has the advantages in that, in application, by adding the sealing film or the upper cover onto the conventional disposable cup, bowl, or meal box, the game functions of context interactions can be obtained readily, without the need to increase production cost. Thus, this may catch the attention of the people around the user while eating and dining.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from the detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed descriptions with reference to the attached drawings.

Refer to FIGS. 1 to 10 respectively for a schematic diagram showing inserting a suction tube into a disposable container to perform games according to the present invention; schematic diagrams of the disposable sealing pieces in various configurations according to the present invention; schematic diagrams of sealing films for various games according to the present invention; a schematic diagram showing inserting a tooth pick or a fruit fork into a disposable container to perform games according to the present invention; a schematic diagram showing rotating a suction tube to perform games according to the present invention; a schematic diagram showing various playing tools for puncturing through the sealing film or upper cover according to the present invention; cross section views showing a rotation pointer in various configurations according to the present invention; a schematic diagram showing a detachable rotation pointer disposed on a disposable sealing piece according to the present invention; a schematic diagram showing a rotation pointer disposed on a disposable sealing piece of an instant noodle bowl according to the present invention; and a schematic diagram showing a rotation pointer disposed on a disposable sealing piece of a meal box according to the present invention.

Before plunging into details of the present invention, it is worthwhile to explain the symbols and their meanings, and also the related game playing rules in FIGS. 1 to 9, to facilitate reading and comprehension, as explained as follows.

Figure 1:
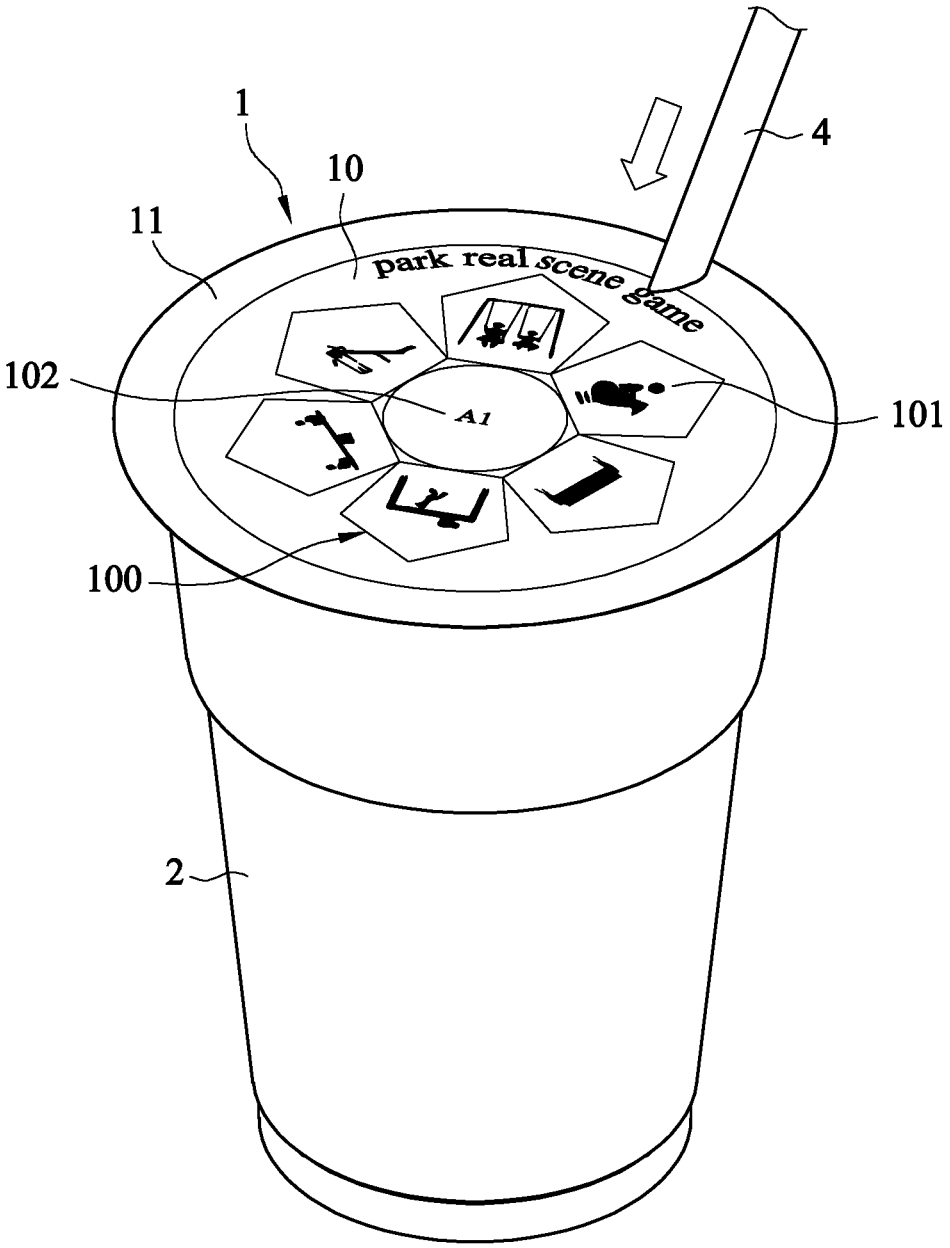
FIG. 1 is a schematic diagram showing inserting a suction tube into a disposable container to perform games according to the present invention.

Refer to FIGS. 1 to 9 for the following explanations. As shown in FIG. 1, the symbol A1 means that: play the selected game 3 times. As shown in FIG. 2A, the symbols B1, B2, B3 B4, B5, B6, B7, B8, B9 mean respectively: kiss mon, drink two mouthfuls, take a rest, drink one mouthful, eat two mouthfuls, feed two mouthfuls, eat three mouthfuls, feed one mouthful, and mom kiss. The game playing rules are: close your eyes, pray faithfully, turn the cup around 3 circles, to take actions based on result. As shown in FIG. 2C, the symbols C1, C2, C3 C4, C5, C6, C7, C8, C9 mean respectively: kiss mon, drink two mouthfuls, take a rest, drink one mouthful, eat two mouthfuls, feed two mouthfuls, eat three mouthfuls, feed one mouthful, and mom kiss. The game playing rules are: close your eyes, pray faithfully, turn the cup around 3 circles, to take actions based on result. As shown in FIG. 3A, the symbol D1 means play the selected game 3 times. As shown in FIG. 3B, the symbol 102 means that: when hit the left side car brand name, drink one mouthful; when hit the right side car brand name, drink two mouthfuls; when hit the middle car brand name, drink five mouthfuls. As shown in FIG. 3G the symbols E1, E2, E3 E4, E5, E6, E7, E8, E9, E10 mean respectively: kiss mon, drink two mouthfuls, take a rest, drink one mouthful, eat two mouthfuls, feed two mouthfuls, eat three mouthfuls, feed one mouthful, mom kiss, and parent-child section. The game playing rules are: close your eyes, pray faithfully, turn the cup around 3 circles, to take actions based on result.

Figure 3A:
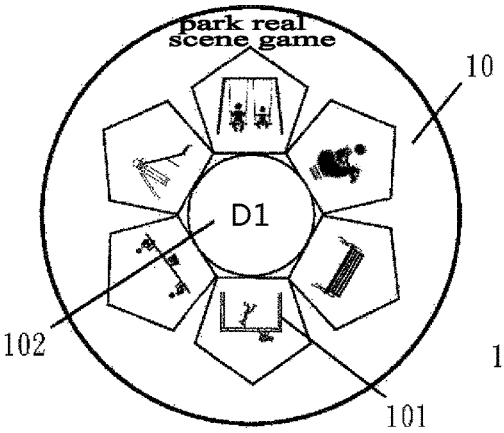
FIGS. 3A to 3V are schematic diagrams of sealing films for various games according to the present invention.
Figure 3B:
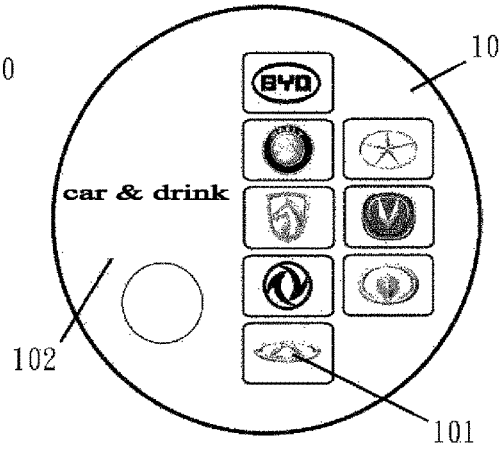
Figure 3C:
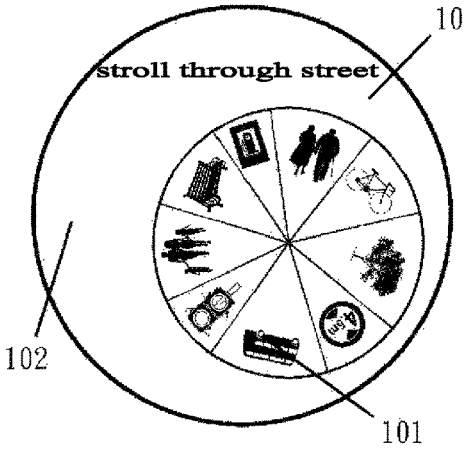
Figure 3D:
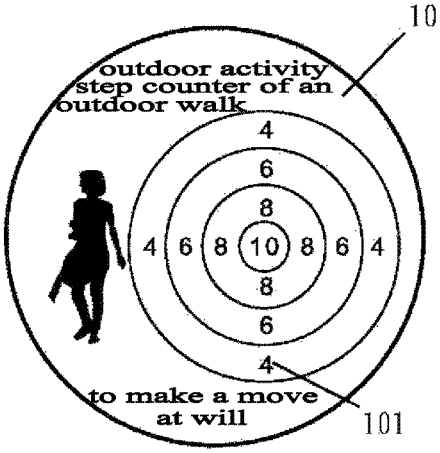
Figure 3E:
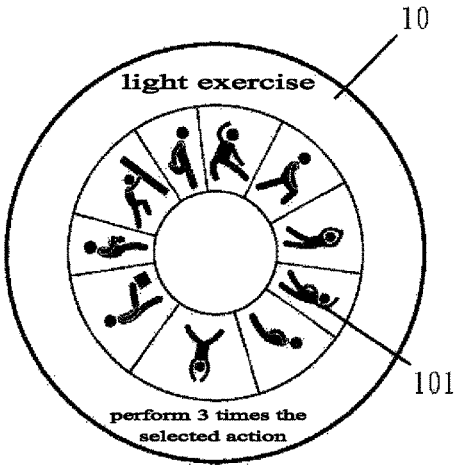
Figure 3F:
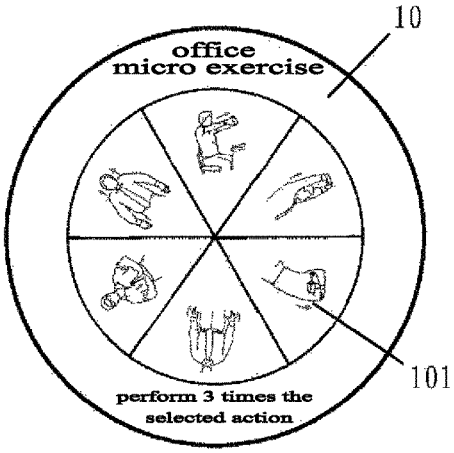
Figure 3G:
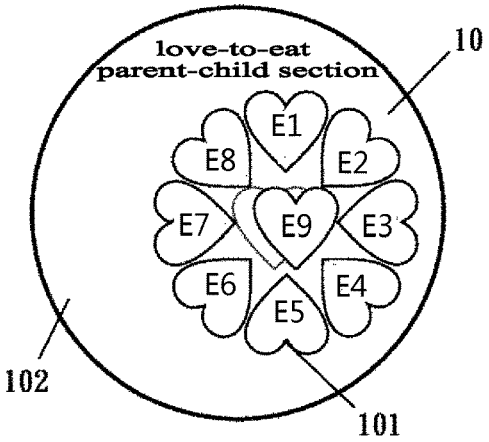
Figure 3H:
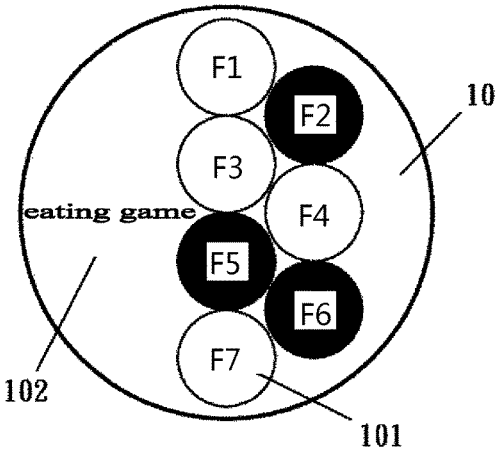

As shown in FIG. 3H, the symbols F1, F2, F3 F4, F5, F6, F7 mean respectively: one mouthful, one mouthful, three mouthfuls, one mouthful, one mouthful, one mouthful, two mouthfuls, and two mouthfuls. The symbol 102 means that: in case of the white ball, eat by yourself, in case of the black ball, fed by mom. As shown in FIG. 3K, the game playing rules are: puncture 3 times, to finish the selected action in sequence. As shown in FIG. 3L, the symbol 102 means memorize the truck silently, when puncturing the pattern, make gesture at once. As shown in FIG. 3M, the symbol 102 means that: finish the selected action. As shown in FIG. 3O, the symbol 102 means that close your eyes, pray faithfully, turn the cup around 3 circles, to obtain the forecast result. The symbols G1, G2, G3 G4, G5, G6, G7, G8, G9 mean respectively: love me, friends only, love me intensely, budding, do not love me, love in my heart, love me a little, no feeling, love forever. As shown in FIG. 3P, the forecast explanations are: close your eyes, pray faithfully, turn the cup around 3 circles, puncture the suction tube into plastic film, to obtain the forecasted probability.

Figure 3I:
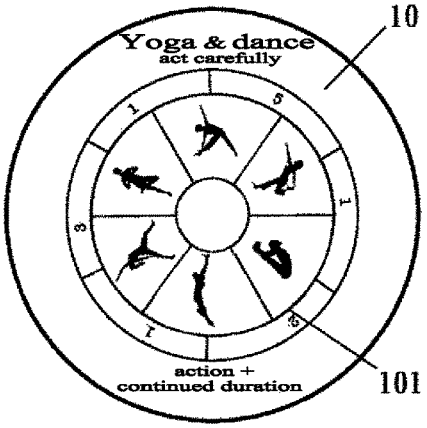
Figure 3J:
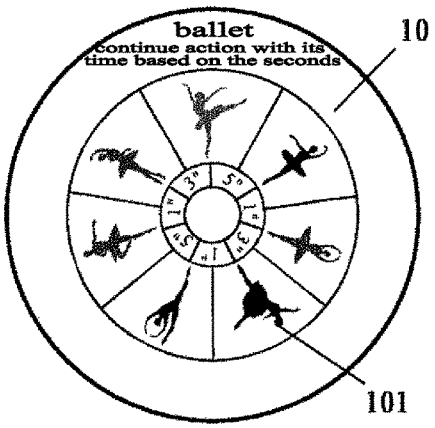
Figure 3K:
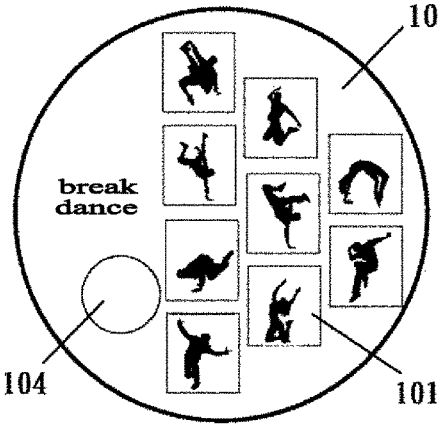
Figure 3L:
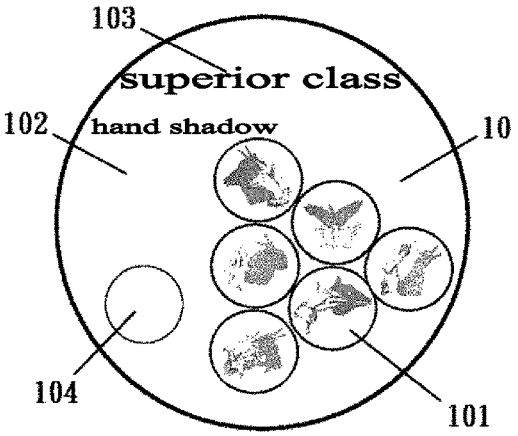
Figure 3M:
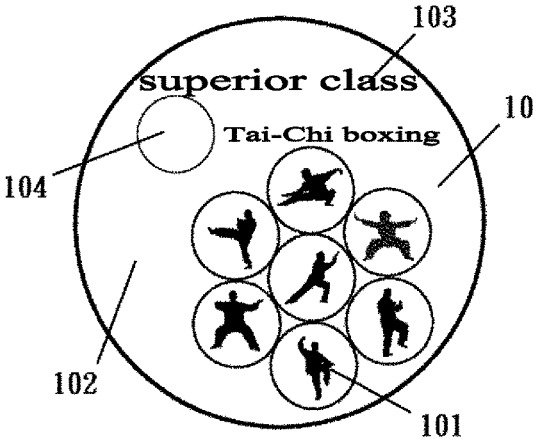
Figure 3N:
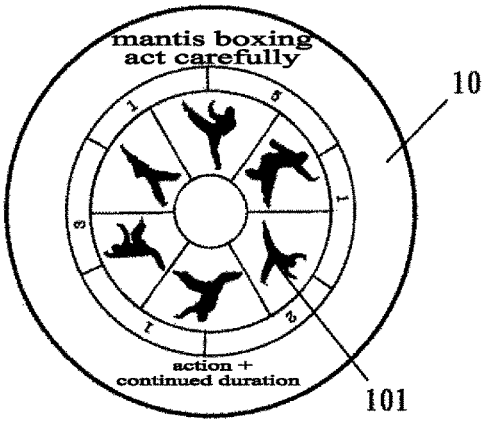
Figure 3O:
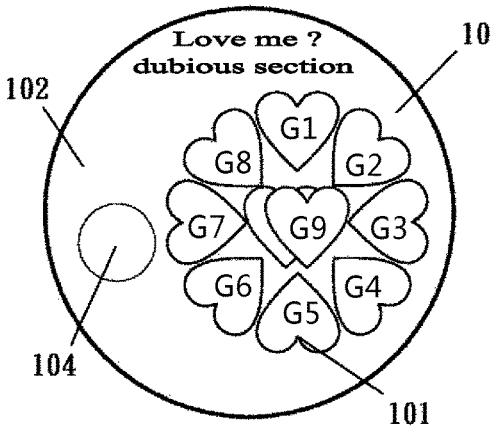
Figure 3P:
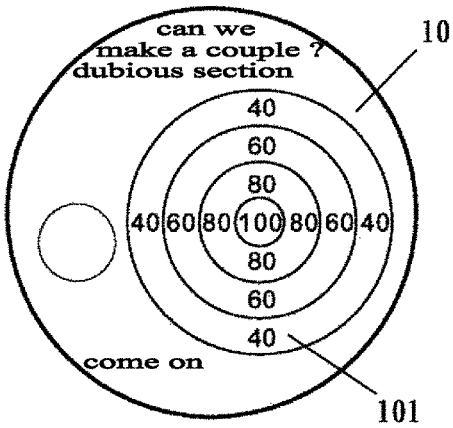
Figure 3Q:
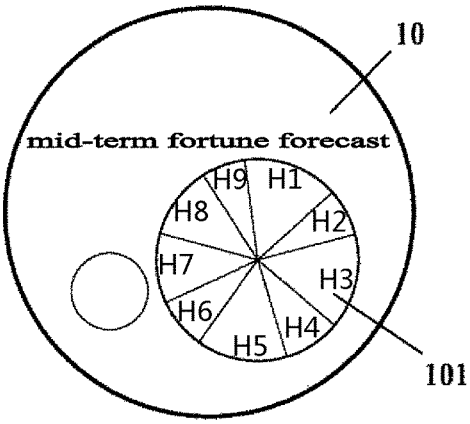
Figure 3R:
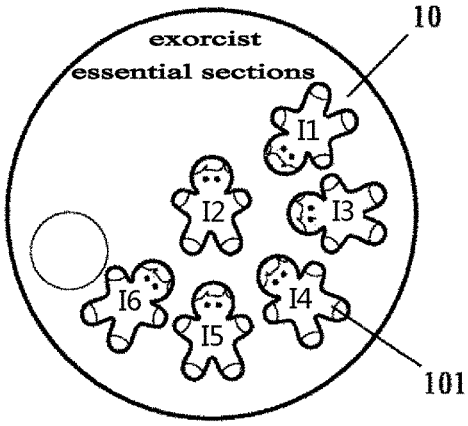
Figure 3S:
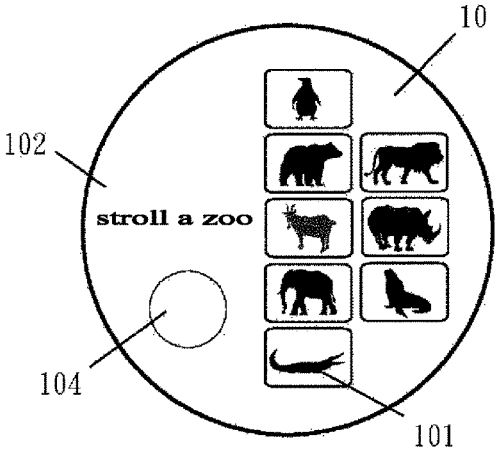
Figure 3T:
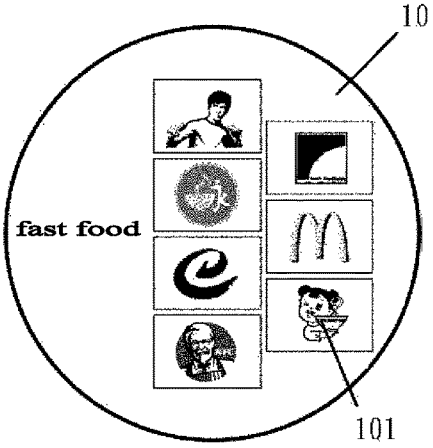
Figure 3U:
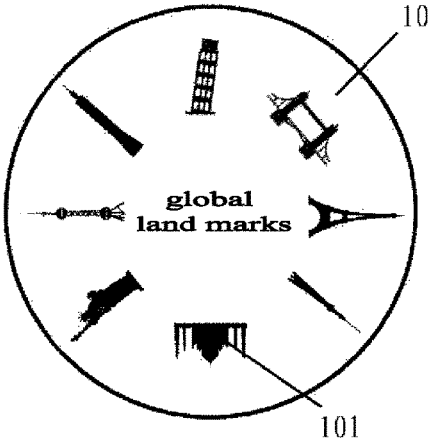
Figure 3V:
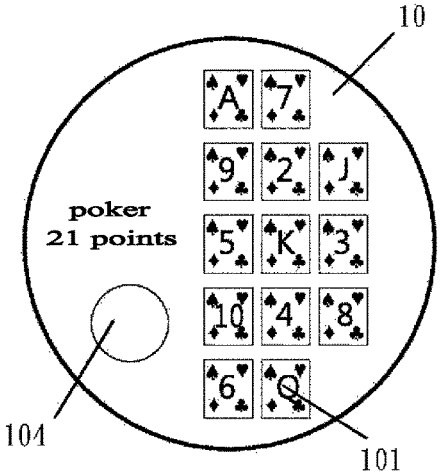

As shown in FIG. 3Q, the mid-term fortune forecasts are: close your eyes, pray faithfully, turn the cup around 3 circles, puncture the suction tube into plastic film, to obtain the mid-term fortune. The symbols H1, H2, H3 H4, H5, H6, H7, H8, H9 mean respectively: bad luck leaves and good luck comes, be aware of bad person, great fortune coming, helpful friend's assistance, meet fortune, be careful of financial loss, bright future, women lover you, rich and powerful. As shown in FIG. 3R, the descriptions of mind method are: close your eyes, pray faithfully, turn the cup around 3 circles, puncture the suction tube into plastic film. If you hit bad person pattern, then you successfully eliminate that bad person. The symbols I1, I2, I3 I4, I5, I6 mean respectively: bad leader, bad boss, bad friend, debtor, bad relative, intruder. As shown in FIG. 3S, the symbol 102 means: when hit the left side animal, drink a mouthful, when hit the right side animal, drink two mouthfuls, when hit the middle animal, drink five mouthfuls. As shown in FIG. 3T, the game explanations are: tell the brand name and main course for the pattern punctured. As shown in FIG. 3U, the game explanations are: close your eyes, pray faithfully, turn the cup around 3 circles, to tell immediately city of the landmark. As shown in FIG. 3V, the game explanations are (for poker 21 points): close your eyes, pray faithfully, turn the cup around 3 circles, puncture the suction tube into plastic film. The one having total count nearest 21 points is a winner (refer to the ordinary poker 21 point meaning).

Figure 4:
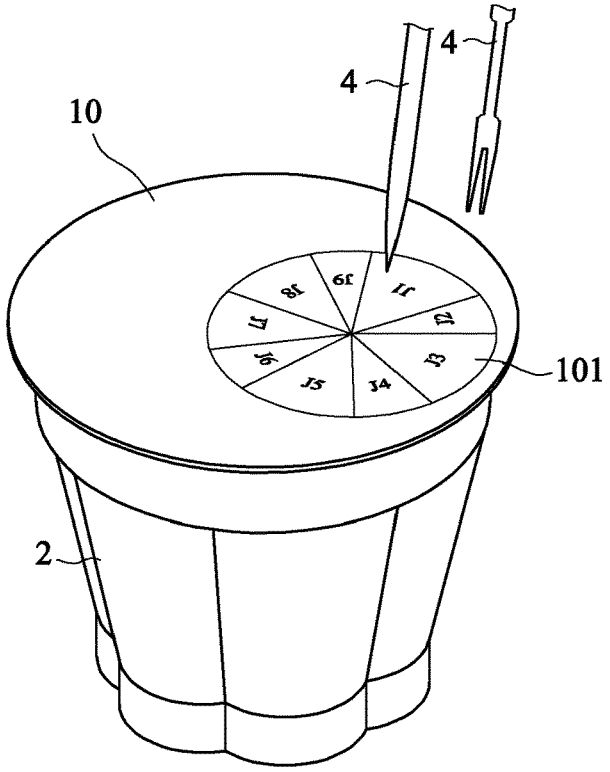
FIG. 4 is a schematic diagram showing inserting a tooth pick or a fruit fork into a disposable container to perform games according to the present invention.
Figure 5:
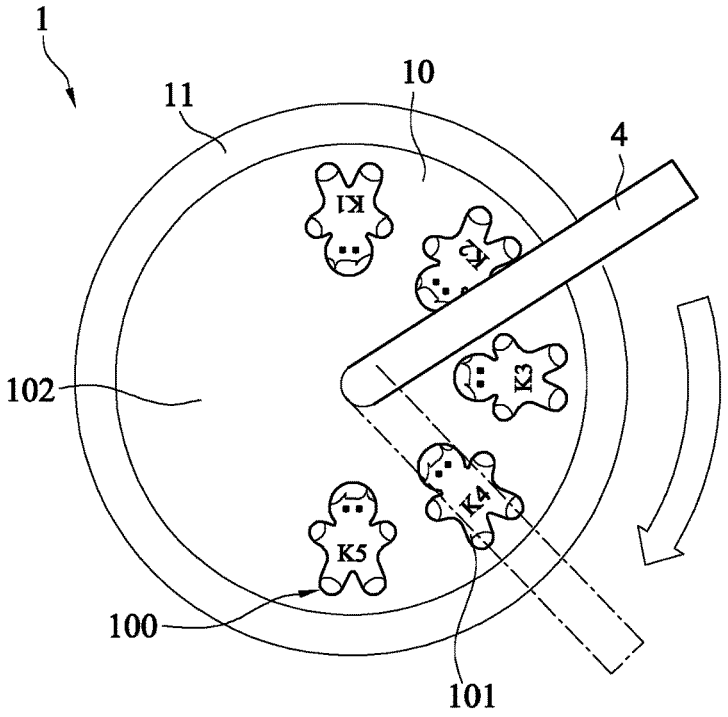
FIG. 5 is a schematic diagram showing rotating a suction tube to perform games according to the present invention.
Figure 8:
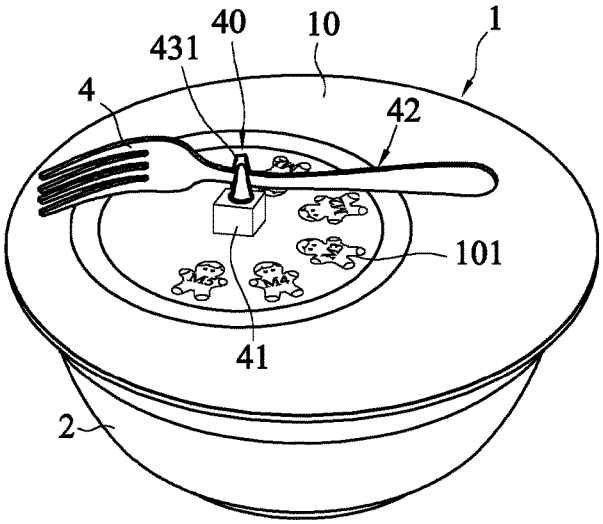
FIG. 8 is a schematic diagram showing a detachable rotation pointer disposed on a disposable sealing piece according to the present invention.
Figure 9:
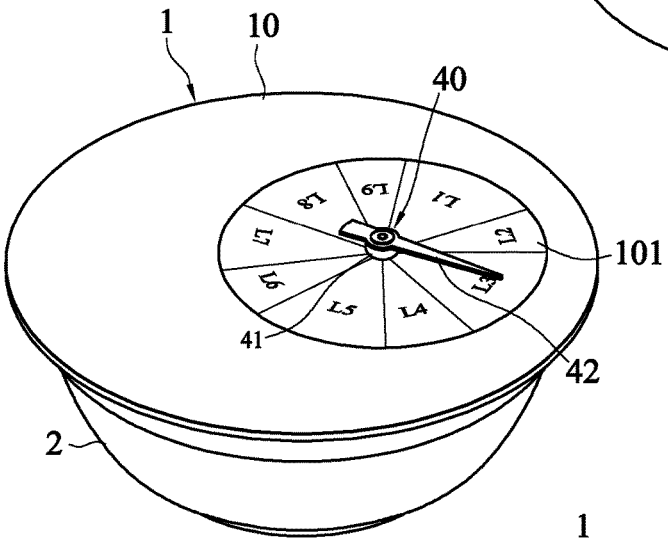
FIG. 9 is a schematic diagram showing a rotation pointer disposed on a disposable sealing piece of an instant noodle bowl according to the present invention.
Figure 10:
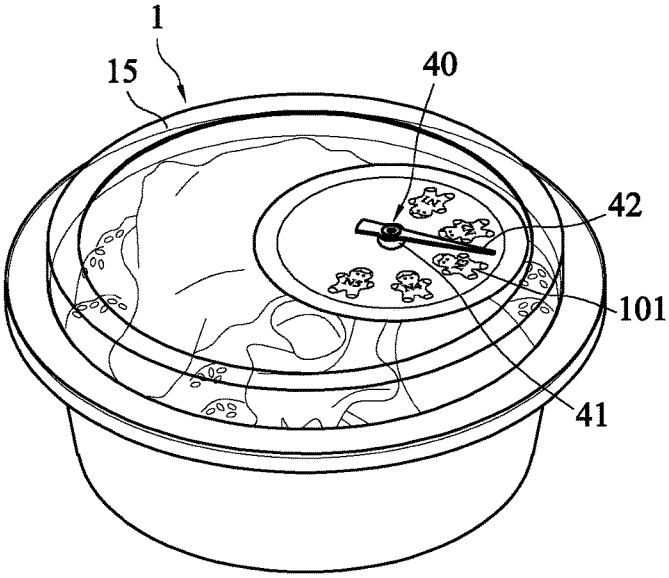
FIG. 10 is a schematic diagram showing a rotation pointer disposed on a disposable sealing piece of a meal box according to the present invention.

As shown in FIG. 4, the mid-term fortune forecasts are: close your eyes, pray faithfully, turn the cup around 3 circles, puncture the suction tube into plastic film, to obtain the mid-term fortune. The symbols J1, J2, J3 J4, J5, J6, J7, J8, J9 mean respectively: bad luck leaves and good luck comes, be aware of bad person, great fortune coming, helpful friend's assistance, meet fortune, be careful of financial loss, bright future, women lover you, rich and powerful. As shown in FIG. 5, the descriptions of mind method are: close your eyes, pray faithfully, turn the cup around 3 circles, puncture the suction tube into plastic film. If you hit bad person pattern, then you successfully eliminate that bad person. The symbols K1, K2, K3 K4, K5 mean respectively: debtor, bad relative, bad boss, bad friend, intruder. As shown in FIG. 8, the descriptions of mind method are: close your eyes, pray faithfully, turn the cup around 3 circles, puncture the suction tube into plastic film. If you hit bad person pattern, then you successfully eliminate that bad person. The symbols M1, M2, M3 M4, M5 mean respectively: debtor, bad relative, bad boss, bad friend, intruder. As shown in FIG. 9, the mid-term fortune forecasts are: close your eyes, pray faithfully, turn the cup around 3 circles, puncture the suction tube into plastic film, to obtain the mid-term fortune. The symbols L1, L2, L3 L4, L5, L6, L7, L8, L9 mean respectively: bad luck leaves and good luck comes, be aware of bad person, great fortune coming, helpful friend's assistance, meet fortune, be careful of financial loss, bright future, women lover you, rich and powerful. As shown in FIG. 10, the symbols N1, N2, N3 N4, N5 mean respectively: debtor, bad relative, bad boss, bad friend, intruder.

Now, we are ready to discuss in detail the technical contents of the present invention. As shown in FIGS. 1 to 4, the present invention provides a disposable sealing piece having a game unit, used to cover and seal an opening of a disposable container 2. The disposable sealing piece 1 is formed by a sealing film 10 or an upper cover 15. A print layer 100 is disposed on a surface of the disposable sealing piece 1, and at least a game unit 101 is disposed on the print layer 100.

Figure 2A:
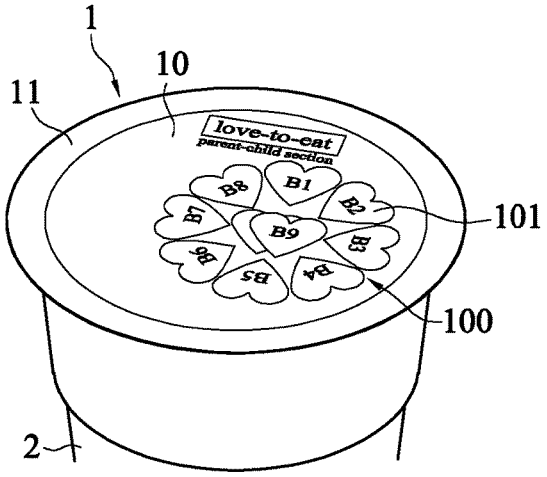
FIGS. 2A to 2D are schematic diagrams of the disposable sealing pieces in various configurations according to the present invention.
Figure 2B:
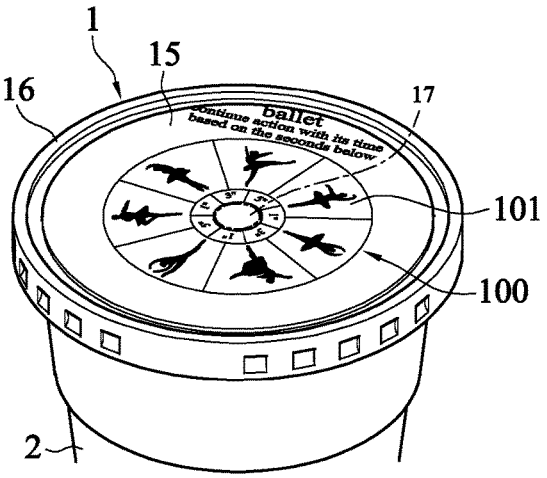

Then, as shown in FIGS. 2A and 2B, a pattern of the game unit 101 on the print layer 100 is printed directly on the surface of the sealing film 10 or an upper cover 15.

Figure 2C:
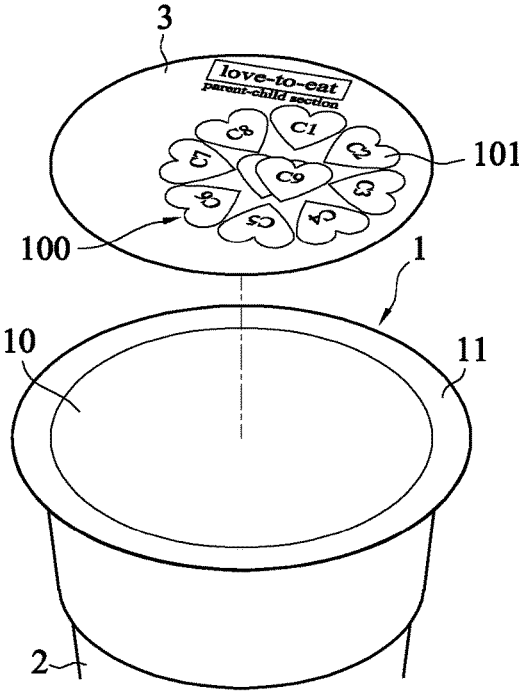
Figure 2D:
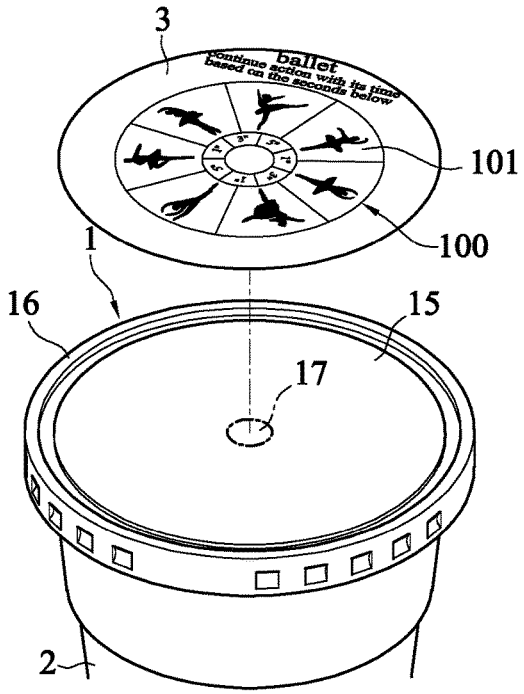

Further, as shown in FIGS. 2C and 2D, the pattern of the game unit 101 of the print layer 100 is first printed on a sticker 3, then the sticker 3 is glued onto the surface of the sealing film 10 or the upper cover 15.

Moreover, as shown in FIGS. 3A to 3V, the game unit 101 can be classified into at least eight sequences, that include but not limited to: a real life reality sequence, a regimen and health care sequence, a human interaction sequence, a yoga & dance sequence, a child cherish sequence, a Kungfu boxing sequence, a divination healing sequence, and a child wisdom enhancement sequence. In fact, the game contents can be much more than that mentioned above, and the present invention is not limited to the above.

Figure 6:
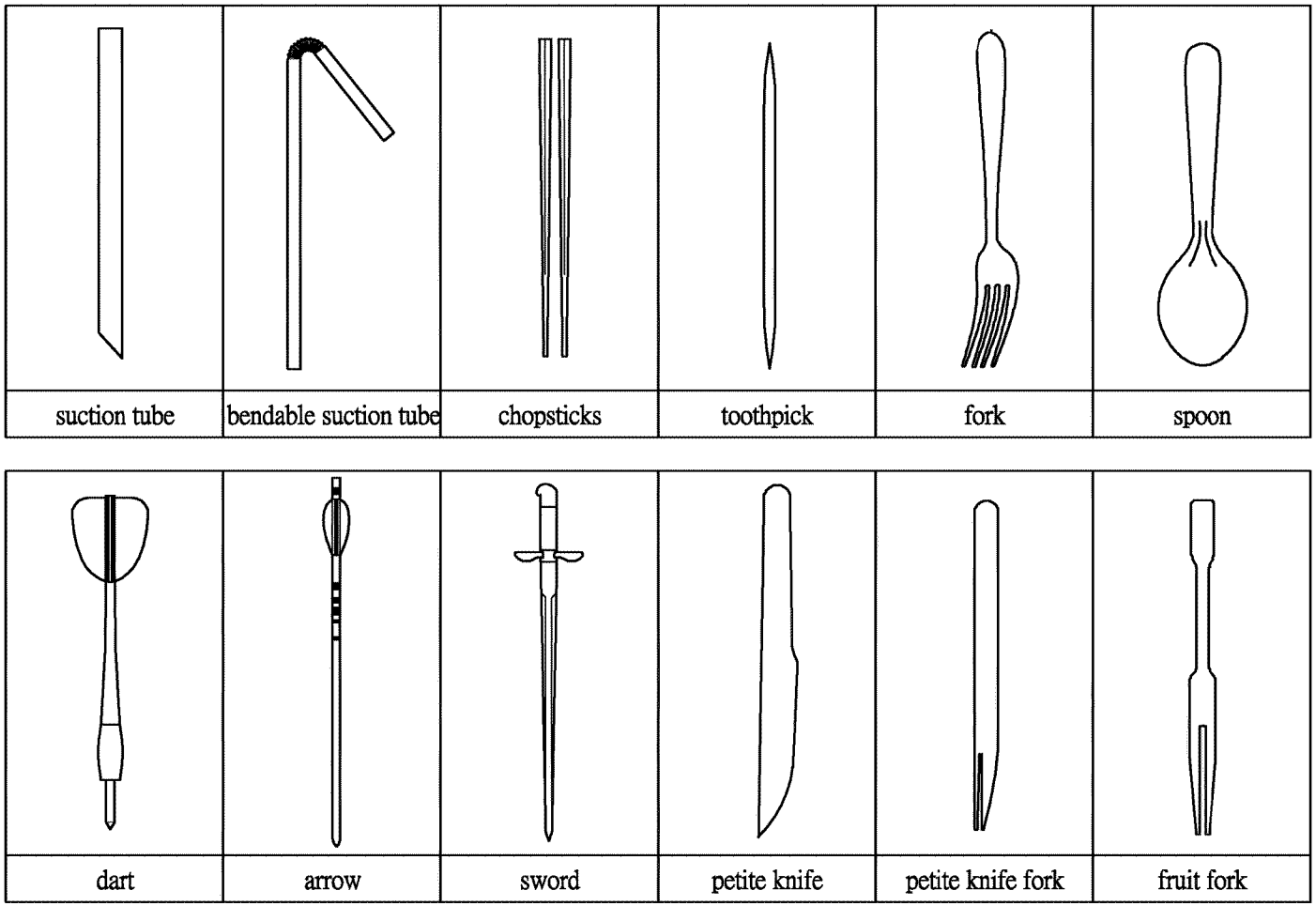
FIG. 6 is a schematic diagram showing various playing tools for puncturing through the sealing film or upper cover according to the present invention.

Summing up the above, as shown in FIGS. 1, 4, and 5, when the disposable container 2 such as a cup, a bowl, or a meal box, is covered with a sealing film 10 or an upper cover 15, they could provide various games of context interactions. As such, in enjoying a meal, the user may pick up any playing tools 4 nearby (as shown in FIG. 6), such as a straw, chopsticks, a tooth pick, a fork, a spoon, a petite knife, petite knife and fork, a fruit fork utilized in our daily life; or even a dart, an arrow, a sword, and a knife of specially made tools, to act in cooperation with the game unit 101 to play the games. As such, various simple, playful, and interesting games of context interactions can be played on the game unit 101 of the disposable sealing piece 1, to bring happiness and delight to a user while he is eating and dining.

As shown in FIGS. 1, and 4, in the present invention, in playing the games, a suction tube, a tooth pick, or a fruit fork can be used as a playing tool 4 to realize its purpose. Or, the disposable container 2 is first rotated, then the suction tube, the tooth pick, or the fruit fork can be used as a playing tool 4 to be inserted into the disposable container 2 to play the games. Further, as shown in FIG. 5, a playing tool 4 such as a suction tube can be inserted into the disposable container 2, then rotate the suction tube to select the game to play. The descriptions above is for illustrations only, but the present invention is not limited to this.

The present invention is simple in structure, low in production cost, and easy to be mass produced. Compared with the Prior Art, the present invention has the advantages in that, in application, by adding the sealing film 10 or the upper cover 15 onto the conventional disposable cup, bowl, or meal box, various game of context interactions can be obtained readily, without the need to increase production cost. Thus, this may catch the attention of the people around the user while eating and dining.

In fact, the function and effect of the games of context interactions of the present invention far exceed that of the conventional games. In the present invention, sealing film 10 or the upper cover 15 is used as a carrier. Through integrating novel and interesting drawing designs into the games or activities of daily life real scene, the games are richer in contents, to make eating and dining more interesting and worthwhile. As such, the user may either take light exercise or activities indoors, to stretch his legs and body, or he may go outdoors into the scene of real to get a relaxing and refreshing experience, to avoid getting bored or depressed in a room. Therefore, this function evidently can not be obtained in the Prior Art.

As shown in FIGS. 3A to 3V, in the present invention, the game unit 101 capable of context interactions is provided with patterns of deliberate designs. Through the design of patterns and characters, the environment, body activities, and emotions/state of minds can be integrated together to present various games or activities. In the following, the game unit 101 is described in more detail, but the present invention is not limited to this.

The game unit 101 includes one of the print patterns of one of the following sequences:

A real life reality sequence, as shown in FIGS. 3A to 3D, and that includes a real scene game in a park, strolling along a street, car and drink, outdoor activities.

A regimen and health care sequence, as shown in FIGS. 3E and 3F, and that includes light exercise, office micro exercise, and various other designs, such as dynamic warm-up, static warm-up, target exercise, and health exercise.

A human interaction sequence, as shown in FIGS. 3G to 3H, and that includes love-to-eat, eating game, and various other designs, such as parent and child interactions, male and female interactions, and diehard followers' interactions.

A yoga & dance sequence, as shown in FIGS. 3I to 3K, and that includes yoga, ballet, break dance, and various other designs, such as street dance, pedal dance, and folk dance.

A child cherish sequence, as shown in FIG. 3L, and that includes hand shadow game, and various other designs, such as string magic trick, one-foot push, and grabbing sandbag.

A Kungfu boxing sequence, as shown in FIGS. 3M and 3N, and that includes Tai-Chi boxing, and mantis boxing, and various other designs, such as eight-trigram palm, and one-finger-acts-like-a-pen.

A divination healing sequence, as shown in FIGS. 3O to 3R, and that includes do-you-love-me, can we make a couple, forecast of fortune, exorcist, and various other designs.

A child wisdom enhancement sequence, as shown in FIGS. 3S to 3V, and that includes strolling through a zoo, eating fast food, global land marks, poker, and various other designs, such as dice, and numeral games.

With regards to the games and activities, it can be explained in more details as follows. As shown in FIGS. 3A to 3D, for the real scene game, the contents of FIG. 3A can be combined with a specific location (for example, a community park), as the game location. As such, the beverage is combined with the facility and the scene, so that the game is more lively and interesting, and that can not be obtained in the Prior Art.

In addition, as shown in FIGS. 3B and 3C, in which street scene is a major element of a game, so that the user may stroll along the street to enjoy the scene, while drinking the beverage, to add more fun to street strolling.

Also, as shown in FIG. 3D, wherein the contents remind and encourage the user to go outdoors for a walk, to be beneficial to the health of the user.

As shown in FIGS. 3E and 3F, in the regimen and health care sequence, through the game on the beverage cup, user is prompted to take some light and simple exercises. As such, it may prevent the so-called modern civilization disease caused by sitting long hours in the office.

As shown in FIGS. 3G and 3H, in the human interaction sequence, the ordinary parent-child interaction of feeding a child can be made to be more vivid and interesting. In this approach, a child can be made to have the motive to eat, while parent-child relation is improved. Therefore, the boring and tedious child feeding is turned into a happy eating game.

As shown in FIGS. 3I, 3K, 3M, 3N, in the yoga & dance sequence and the Kungfu boxing sequence, the body gesture and movement are presented for the user to imitate. As such, the user is guided into the activities of yoga & dance and Kungfu boxing, in realizing the objective of promoting yoga & dance and Kungfu boxing.

As shown in FIGS. 1, 3A to 3V, a plurality of different or similar patterns of the game unit 101 can be disposed on the print layer 100, to form a set of drawings or a chain of drawings, printed in sequence on the sealing film 10. In application, on the sealing film of the disposable container 2, a plurality of patterns of the game unit 101 may appear sequentially, so that the user may enjoy various games, without the need to buy additional game cups. Therefore, the user may save money, while having a novel and interesting experience.

As shown in FIGS. 3K to 3M, in addition to a game unit 101 printed on the print layer 100, a marking region may also be disposed on the print layer 100. The marking region is used to print a text description unit 102, with its contents corresponding to the game unit 101; and a trade mark identification unit 103, to mark the brand of a company or its product. Besides, a round shape transparent small window 104 can be provided on the print layer 100, for a user to view directly the beverage in the container. Or, the transparent small window 104 can be used as a marking position for a suction tube to insert in.

In the present invention, the disposable container 2 can be a cup, a bowl, a can, or a meal box (not shown), and it can be made by paper, plastic, and aluminum. The disposable container 2 made of plastic is formed by polyethylene terephthalate (PET), polypropylene (PP), styrene (PS), styrofoam (polystyrene), biaxial oriented polystyrene (OPS), or poly lactic acid (PLA). The disposable container 2 may further be finely classified as a beverage cup, a soup cup, a soft serve ice cream cup, a coffee cup, a jelly cup, a yogurt cup, a soup bowl, an instant noodle bowl, and a meal box, to serve as a disposable container for containing food.

As shown in FIGS. 1, 3A to 3V, the sealing film 10 can be made of an aluminum foil, a paper film, an easy open film, and plastic film (for example: AE film, PE film, and PP film). The shape of the sealing film 10 can be designed to match that of the opening of the disposable container 2, such as a round shape, a square shape, a rectangle shape, or an elliptic shape. Around the outer most portion of the sealing film 10 is provided with a ring of sealing edge 11 (as shown in FIG. 1), but the present invention is not limited to this.

As shown in FIGS. 2B, 2D, around the upper cover 15 is provided with a fastening cover rim 16, to enhance the sealing effect. In the center of the upper cover 15 is provided with a tangent line insertion port 17. The upper cover 15 can be made of aluminum foil or plastic, such as polyethylene terephthalate (PET), polypropylene (PP), styrene (PS), biaxial oriented polystyrene (OPS), or poly lactic acid (PLA). The shape of the upper cover 15 can be designed to match that of the opening of the disposable container 2, such as a round shape, a square shape, a rectangle shape, or an ellipsis shape, but the present invention is not limited to this.

In addition, as shown in FIGS. 7A to 10, on the disposable sealing piece 1 of the disposable container 2 is provided with a rotation pointer 40, to be used as a playing tool 4. to act in cooperation with the game unit 101 to play the games. The rotation pointer 40 includes a base seat 41 and a rotable needle 42. One end of the base seat 41 is fixed in the center of the game unit 101 located on the disposable sealing piece 1, while the other end of the base seat 41 is pivotally connected to the rotable needle 42, so that rotation pointer 40 can be rotated to the pattern of the game unit 101 selected to play.

Figure 7A:
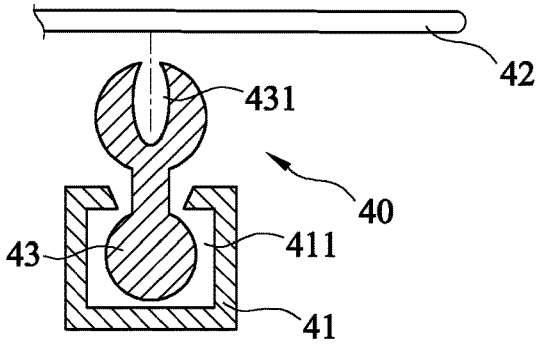
FIGS. 7A to 7D are cross section views showing a rotation pointer in various configurations according to the present invention.

Moreover, as shown in FIGS. 7A and 8, the base seat 41 is provided with a cavity 411. The rotation pointer 40 is provided with a ball shape tenon 421, that can be pivotally connected to the rotable needle 42. One end of the ball shape tenon 421 is protruded into a clip 431, for a detachable and rotable needle 42 to be placed into and assembled. The detachable and rotable needle 42 can be formed by an ordinary rod., such that the clip 431 can directly clip a chopstick, a fork/knife, a bamboo stick, or a suction tube. As such, the rotable needle 42 can be rotated to the selected pattern of the game unit 101, to play simple and funny games on the disposable sealing piece 1, to make dining and eating more interesting and colorful.

Figure 7B:
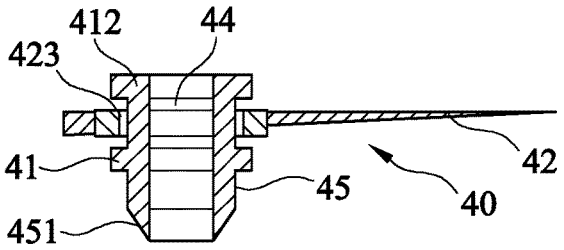

Besides, as shown in FIG. 7B, on the base seat 41 is disposed a protrusion pillar 412, and around the protrusion pillar 412 is disposed a ring of groove 413. The end portion of the rotable needle 42 is disposed a sleeve ring 423, to be pivotally sleeved into the groove 413 of the protrusion pillar 412. In a bottom portion of the base seat 41 is provided with an insertion and connection portion 45, and a front portion of the insertion and connection portion 45 is provided with a cone shape puncture end 451, to facilitate the rotation pointer 40 to insert into and fix on the disposable sealing piece 1 of the disposable container 2. In addition, a suction tube insertion hole 44 is disposed between the protrusion pillar 412 of the base seat 41 and the puncture end 451, to facilitate the insertion of the suction tube, in realizing convenience in usage.

Figure 7C:
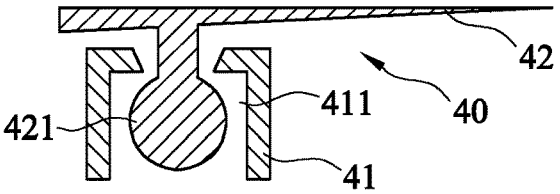
Figure 7D:
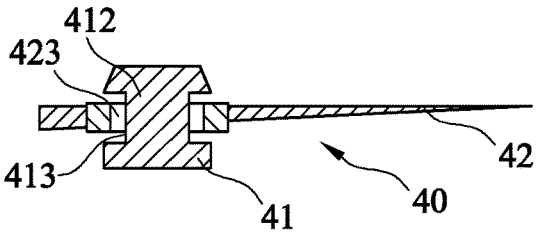

Further, as shown in FIGS. 7C and 7D, in application, the base seat 41 can be glued directly on to the disposable sealing piece 1 of the disposable container 2 (as shown in FIGS. 9, 10), to be fixed correspondingly into the center of the game unit 101. Then, the user may rotate the rotation pointer 40 to play the games, to add interests and delights to the routine and boring eating and dining. The instance just mentioned is for applying the rotation pointer 40 to the disposable sealing piece 1 of the disposable container 2 for an instant noodle bowl or a meal box, but the present invention is not limited to this. For instance, the rotation pointer 40 can be applied similarly onto the disposable container 2 of a beverage cup, a soup cup, a soft serve ice cream cup, a coffee cup, a jelly cup, a yogurt cup, a soup bowl.

Summing up the above, in the present invention, quite a lot of games are designed to play on an ordinary beverage cup. The games are realized and presented through using planar drawings or patterns, that can be printed (or glued) on the sealing film for the cup cover of a disposable container, or on the cup cover of a meal box. The disposable sealing piece having a game unit of the present invention is novel in design, simple in structure, and easy to assemble, and is capable of providing recreation and entertainment of context interactions to the user.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A disposable sealing piece used to cover and seal an opening of a disposable container, characterized in that:

the disposable sealing piece is formed by a sealing film or an upper cover, the sealing film is made of one of the following: a metal film, a paper film, and a plastic film, around a perimeter of the upper cover is disposed a ring of fastening cover rim, and the upper cover is made of metal or plastic, and a print layer is disposed on a surface of the disposable sealing piece, and at least a game unit is disposed on the print layer, to act in cooperation with a playing tool to perform selection of games;

wherein patterns of the game unit on the print layer is formed by two modes respectively, in a first mode, a pattern of the game unit of the print layer is printed directly on the sealing film, in a second mode, the pattern of the game unit of the print layer is first printed on a sticker, then the sticker is glued onto the surface of the sealing film;

on the print layer is provided with a marking region, that is printed a text description unit, corresponding to that of the game unit;

the game unit includes a print pattern of one of the following sequences: a real life reality sequence including a real scene game in a park, strolling through a street, car and drink, outdoor activities, a regimen and health care sequence including light exercise, office micro exercise, dynamic warm-up, static warm-up, target exercise, health exercise, a human interaction sequence including love-to-eat, eating game, a yoga and dance sequence including yoga, ballet, break dance, street dance, pedal dance, folk dance, a child cherish sequence including hand shadow game, string magic trick, one-foot push, grabbing sandbag, a Kungfu boxing sequence including Tai-Chi boxing, and mantis boxing, a divination healing sequence including do-you-love-me, can we make a couple, forecast of fortune, exorcist, and a child wisdom enhancement sequence including strolling through the zoo, eating fast food, global land mark, poker, dice, and numeral games; and the playing tool includes one of the following: chopsticks, a tooth pick, a fork, a spoon, a petite knife, a petite knife and fork, a fruit fork used frequently in our daily life; and a dart, an arrow, a sword, and a knife of specially made tools;

wherein the sealing film is formed by one of a plurality of continuous sealing films, on the respective sealing films various different games are played, such that the sealing films are matched and applied to the various different games respectively appearing at random on the opening of the disposable container.

2. The disposable sealing piece having a game unit as claimed in claim 1, wherein the marking region includes a trade mark identification unit, and a transparent small window of a round shape.

3. The disposable sealing piece having a game unit as claimed in claim 1, wherein the playing tool is provided with a rotation pointer for selecting games, the rotation pointer includes a base seat and a rotatable needle, one end of the base seat is fixed in a center of the game unit on the disposable sealing piece, and the rotatable needle is pivotably connected to the other end of the base seat, to be rotated to point to the pattern of the game unit, the rotation pointer is fixed onto the disposable sealing piece, or the rotation pointer is used as an accessory for a user to place it onto the disposable sealing piece as required.

4. The disposable sealing piece having a game unit as claimed in claim 3, wherein the base seat is provided with a cavity, and the rotatable needle is pivotably connected to a ball shape tenon.

5. The disposable sealing piece having a game unit as claimed in claim 3, wherein the base seat is provided with a cavity, being pivotably connected to the ball shape tenon, one end of the ball shape tenon is protruded to have a clip, for clipping the detachable and rotatable needle.

6. A playing tool and a disposable sealing piece used to cover and seal an opening of a disposable container, characterized in that:

the disposable sealing piece is formed by a sealing film or an upper cover, the sealing film is made of one of the following: a metal film, a paper film, and a plastic film, around a perimeter of the upper cover is disposed a ring of fastening cover rim, and the upper cover is made of metal or plastic, and a print layer is disposed on a surface of the disposable sealing piece, and at least a game unit is disposed on the print layer, to act in cooperation with the playing tool to perform selection of games;

wherein patterns of the game unit on the print layer is formed by two modes respectively, in a first mode, a pattern of the game unit of the print layer is printed directly on the sealing film, in a second mode, the pattern of the game unit of the print layer is first printed on a sticker, then the sticker is glued onto the surface of the sealing film;

the game unit includes a print pattern of one of the following sequences: a real life reality sequence, a regimen and health care sequence, a human interaction sequence, a yoga and dance sequence, a child cherish sequence, a Kungfu boxing sequence, a divination healing sequence, and a child wisdom enhancement sequence;

the playing tool includes one of the following: a straw, chopsticks, a tooth pick, a fork, a spoon, a petite knife, a petite knife and fork, a fruit fork used frequently in our daily life; and a dart, an arrow, a sword, and a knife of specially made tools;

the playing tool is provided with a rotation pointer for selecting games, the rotation pointer includes a base seat and a rotatable needle, one end of the base seat is fixed in a center of the game unit on the disposable sealing piece, and the rotatable needle is pivotably connected to the other end of the base seat, to be rotated to point to the pattern of the game unit, the rotation pointer is fixed onto the disposable sealing piece, or the rotation pointer is used as an accessory for a user to place it onto the disposable sealing piece as required;

on the base seat is disposed a protrusion pillar, and around the protrusion pillar is disposed a ring of groove, at an end of the rotatable needle is disposed a sleeve ring, to be pivotably sleeved into the groove of the protrusion pillar of the base seat.

7. A playing tool and a disposable sealing piece used to cover and seal an opening of a disposable container, characterized in that:

the disposable sealing piece is formed by a sealing film or an upper cover, the sealing film is made of one of the following: a metal film, a paper film, and a plastic film, around a perimeter of the upper cover is disposed a ring of fastening cover rim, and the upper cover is made of metal or plastic, and a print layer is disposed on a surface of the disposable sealing piece, and at least a game unit is disposed on the print layer, to act in cooperation with the playing tool to perform selection of games;

wherein patterns of the game unit on the print layer is formed by two modes respectively, in a first mode, a pattern of the game unit of the print layer is printed directly on the sealing film, in a second mode, the pattern of the game unit of the print layer is first printed on a sticker, then the sticker is glued onto the surface of the sealing film;

the game unit includes a print pattern of one of the following sequences: a real life reality sequence, a regimen and health care sequence, a human interaction sequence, a yoga and dance sequence, a child cherish sequence, a Kungfu boxing sequence, a divination healing sequence, and a child wisdom enhancement sequence;

the playing tool includes one of the following: a straw, chopsticks, a tooth pick, a fork, a spoon, a petite knife, a petite knife and fork, a fruit fork used frequently in our daily life; and a dart, an arrow, a sword, and a knife of specially made tools;

the playing tool is provided with a rotation pointer for selecting games, the rotation pointer includes a base seat and a rotatable needle, one end of the base seat is fixed in a center of the game unit on the disposable sealing piece, and the rotatable needle is pivotably connected to the other end of the base seat, to be rotated to point to the pattern of the game unit, the rotation pointer is fixed onto the disposable sealing piece, or the rotation pointer is used as an accessory for a user to place it onto the disposable sealing piece as required;

in a bottom portion of the base seat is provided with an insertion and connection portion, and a front portion of the insertion and connection portion is disposed a cone shape puncture end, and a suction tube insertion hole is disposed between the protrusion pillar of the base seat and the puncture end.

* * * * *